US010076760B2

(12) United States Patent
Jacques et al.

(10) Patent No.: US 10,076,760 B2
(45) Date of Patent: Sep. 18, 2018

(54) PNEUMATICALLY POWERED FOAM SPRAYER

(71) Applicant: Innovative Cleaning Equipment, Inc., Grand Rapids, MI (US)

(72) Inventors: Nicholas D. Jacques, Grand Rapids, MI (US); Dean Louwsma, Grand Rapids, MI (US)

(73) Assignee: INNOVATIVE CLEANING EQUIPMENT, INC., Grand Rapids, MI (US)

( * ) Notice: Subject to any disclaimer, the term of this patent is extended or adjusted under 35 U.S.C. 154(b) by 84 days.

(21) Appl. No.: 13/774,195

(22) Filed: Feb. 22, 2013

(65) Prior Publication Data

US 2014/0239096 A1 Aug. 28, 2014

(51) Int. Cl.

| | |
|---|---|
| ***B05B 7/00*** | (2006.01) |
| ***B05B 12/08*** | (2006.01) |
| ***A62C 31/02*** | (2006.01) |
| ***A62C 31/12*** | (2006.01) |

(52) U.S. Cl.

CPC ..... *B05B 7/0025* (2013.01); *A62C 31/12* (2013.01); *B05B 7/0093* (2013.01); *B05B 12/085* (2013.01); *A62C 31/02* (2013.01)

(58) Field of Classification Search

CPC .... B05B 7/30; B05B 7/32; B05B 7/12; B05B 7/0025; B05B 7/0093; B05B 12/085; A62C 31/02; A62C 31/12; A62C 13/00; A62C 13/003; A62C 13/62; A62C 13/64; A62C 13/76

USPC ..... 239/343, 342, 340, 337, 431, 351, 368, 239/407, 409–412

See application file for complete search history.

(56) References Cited

U.S. PATENT DOCUMENTS

| | | | | |
|---|---|---|---|---|
| 2,968,164 A | | 1/1961 | Hanson | |
| 3,026,045 A | | 3/1962 | Reading | |
| 3,062,453 A | * | 11/1962 | Matthews | B05B 7/2437 239/143 |

(Continued)

FOREIGN PATENT DOCUMENTS

| | | | | |
|---|---|---|---|---|
| GB | 2031724 | * | 8/1979 | A62C 13/54 |
| GB | 2031724 | * | 9/1979 | A62C 13/54 |

*Primary Examiner* — Alexander Valvis
*Assistant Examiner* — Christopher R Dandridge
(74) *Attorney, Agent, or Firm* — Warner Norcross + Judd LLP

(57) ABSTRACT

A pneumatically powered foam sprayer is provided. The foam sprayer includes a spray hose having a spray nozzle, a trigger assembly proximate the spray nozzle, and a pressure-actuated valve responsive to the trigger assembly. An air conduit extends between the pressure-actuated valve and an opening in the trigger assembly. Obstructing the opening with a hand, a finger or a thumb creates a change of air pressure within the air conduit and actuates the pressure-actuated valve to selectively allow the supply of foam into the spray hose. The air conduit may extends longitudinally through an interior portion of the spray hose, or along an exterior portion of the spray hose, and can include a laminar, chemical-resistant outer surface. An internal pump is powered by compressed air through the pressure-actuated valve, and the spray nozzle remains open both during and between uses to prevent the accumulation of pressurized foam within the spray hose.

20 Claims, 8 Drawing Sheets

(56) References Cited

U.S. PATENT DOCUMENTS

| | | | | | |
|---|---|---|---|---|---|
| 3,462,112 | A | | 8/1969 | Vom Brack et al. | |
| 3,610,088 | A | * | 10/1971 | Christensen et al. | 86/20.15 |
| 3,940,065 | A | | 2/1976 | Ware et al. | |
| 4,019,652 | A | | 4/1977 | Suh et al. | |
| 4,176,793 | A | | 12/1979 | Heinrich | |
| 4,569,480 | A | * | 2/1986 | Levey | B05B 7/24 137/334 |
| 4,571,092 | A | | 2/1986 | Switall | |
| 4,807,544 | A | | 2/1989 | Cross et al. | |
| 4,844,610 | A | | 7/1989 | North, Jr. | |
| 4,850,536 | A | | 7/1989 | Teranishi et al. | |
| 5,163,584 | A | | 11/1992 | Huber et al. | |
| 5,381,962 | A | | 1/1995 | Teague | |
| 5,427,181 | A | | 6/1995 | Laskaris et al. | |
| 5,525,046 | A | | 6/1996 | Hartmann | |
| 5,613,773 | A | * | 3/1997 | Scott | A62C 31/12 169/44 |
| 5,645,649 | A | * | 7/1997 | Cole, Jr. | 134/18 |
| 6,138,926 | A | * | 10/2000 | Russo | B05B 7/0025 239/310 |
| 6,357,532 | B1 | * | 3/2002 | Laskaris | A62C 5/00 169/14 |
| 6,394,365 | B1 | * | 5/2002 | Jeanfreau | B05B 7/26 222/386.5 |
| 7,753,290 | B2 | * | 7/2010 | Jacques | A01M 7/0046 239/146 |
| 8,307,907 | B2 | * | 11/2012 | Laskaris et al. | 169/44 |
| 2006/0071097 | A1 | * | 4/2006 | Glauser | B05B 7/1418 239/433 |

* cited by examiner

PNEUMATICALLY POWERED FOAM SPRAYER

BACKGROUND OF THE INVENTION

The present invention relates to powered foam sprayers, and in particular, systems for controlling the discharge of foam effluents from powered foam sprayers for cleaning and for other applications.

Powered foam sprayers have long been recognized as preferred cleaning tools for commercial and industrial cleaning applications. In particular, powered foam sprayers are well suited for coating vertical and elevated surfaces with detergents and other cleaning agents without requiring time-intensive manual brush applications. The foam cleaning agents generally adhere to the surface being cleaned without premature runoff, thereby allowing the cleaning agents added time to more effectively penetrate and sanitize, while also providing the operator with a visual indication of the areas that have already been treated.

Powered foam sprayers often include a pre-mixed cleaning solution for mixing with a supply of compressed air. In these systems, the cleaning solution and the compressed air combine to form a foamy, heterogeneous mixture of gas and liquid. This heterogeneous mixture can sometimes include caustic ingredients that, while effective as a cleaner/degreaser, can be harmful when kept in contact with the human skin. Accordingly, powered foam sprayers typically include a handheld spray nozzle having a manually operated trigger. The manually operated trigger opens and closes a valve in the spray nozzle to provide control over the duration of each foam application and to guard against unintended discharge of foam spray.

Between periods of use, foam can remain captured within the spray hose under high pressure, often intentionally. For example, powered foam sprayers can in some instances rely on back pressure to stop operation of the foam sprayer. In particular, back pressure in the spray hose can be used to actuate a switch upstream of the spray nozzle (e.g. in the foam sprayer), terminating operation of the foam sprayer. More specifically, in some embodiments, the foam sprayer may be driven by a supply of compressed. A portion of the compressed air may be used to pneumatically power a pump that motivates the cleaning solution. Another portion of the air may be introduced into the system upstream from a mixing chamber so that it will mix with the cleaning solution to produce foam, and will assist in moving the foam effluent through the system. In these embodiments, the switch may be a pressure valve that closes off the supply of compressed air upstream from the pump and the mixing chamber. When the spray nozzle trigger is released, the spray nozzle valve closes and continued operation of the foam sprayer causes pressure to build in the spray hose. When the back pressure in the hose gets high enough, it closes the pressure valve, thereby effectively shutting off the foam sprayer. When the spray nozzle trigger is again opened, the pressure in the spray hose is released and the pressure valve opens, which restarts the supply of compressed air to the pump and the mixing chamber. In these types of systems, back pressure in the hose is an intended and important part of the operation of the system. It should be noted that the back pressure in the spray hose will remain even if the foam sprayer is disconnected from all sources of external power, such as the supply of compressed.

The presence of pressurized foam within the spray hose can contribute to workplace injury and can cause damage to the foam sprayer. For example, a twelve foot spray hose having a ¾ inch inner diameter can contain over one thousand cubic centimeters of foam cleaning agent, optionally under pressures greater than 300 PSI. In this regard, the spray hose remains "charged" between uses. An unknowing operator can actuate the trigger on a system that is entirely off and disconnected from a pneumatic supply line, and the foam-induced back pressure can inadvertently discharge from the spray hose. This discharge may spray against a sensitive surface, including for example the operator's hands or face, or other undesirable location. In addition, the pressurized caustic chemicals can work against the interior lining of the spray hose and against the fittings, potentially compromising the structural integrity of the spray hose or its fitting connections over time.

Accordingly, there remains a need for an improved system to leverage the benefits of existing powered foam sprayers while also guarding against inadvertent discharge of pressurized foam cleaning agents. In addition, there remains a need for an improved system for the controlled application of pressurized foam cleaning agents without requiring extensive operator training or added material costs.

SUMMARY OF THE INVENTION

A pneumatically powered foam sprayer is provided. The foam sprayer generally includes a spray hose having a spray nozzle, a trigger assembly proximate the spray nozzle, and an air-pressure-actuated control valve that is responsive to the trigger assembly to selectively allow the supply of foam into the spray hose. In one embodiment, the spray nozzle is at all times open to prevent the accumulation of pressurized foam within the spray hose.

In one embodiment, the foam sprayer is a portable unit powered by an external supply of compressed air. The portable unit includes an air conduit in fluid communication with an opening in the trigger assembly. Compressed air is continuously fed through the air conduit and escapes through the opening. When a foam effluent is desired, the opening is obstructed with a finger or a thumb. The resulting increase of pressure in the air conduit actuates a control valve in the portable unit. Alternatively, the movement of compressed air can create a vacuum at the opening, in which instance an obstruction can cause a decrease in air pressure to actuate the control valve. When actuated, the control valve allows a supply of foam to the spray nozzle for discharge in a desired spray pattern.

In another embodiment, the air conduit extends longitudinally through a substantial portion of the spray hose. Alternatively, the air conduit extends externally to the spray hose. For example, the air conduit may be joined with and parallel to the spray hose, or it may be separate from and wrapped helically around the exterior of the spray hose. The air conduit is formed from a chemical-resistant material being at least as flexible as the spray hose. In addition, the air conduit includes a laminar outer surface to limit losses in foam consistency during travel of the foam effluent through the spray hose. The air conduit terminates at the trigger assembly, which can include a raised boss for placement of the operator's thumb when foam effluent is desired.

In still another embodiment, the foam sprayer includes liquid foam constituents in fluid communication with an aeration chamber in the portable unit. The control valve is operable to control the supply of the liquid foam constituents to the aeration chamber based on a level of air pressure within the air conduit. The first and second foam constituents are pre-mixed in the present embodiment, while in other embodiments the foam constituents intermix within a proportionating chamber upstream of the aeration chamber.

In these and other embodiments, the pneumatically powered foam sprayer provides an effective, low cost solution to many of the problems associated with existing foam sprayers. In particular, the pneumatically powered foam sprayer can lessen the risk of harm associated with the pressurized buildup of caustic chemicals, while also providing a foam effluent having the desired consistency with little, if any, additional material costs over existing foam sprayers and minimal operator training. Moreover, the pneumatically powered foam sprayer does not require an electrical power supply for operation, lessening the risk of electrical shock and avoiding the problem of corrosion to associated electrical subsystems.

These and other features and advantages of the present invention will become apparent from the following description of the invention in accordance with the accompanying drawings and appended claims.

DETAILED DESCRIPTION OF THE CURRENT EMBODIMENTS

The invention as contemplated and disclosed herein includes a pneumatically powered foam sprayer adapted to discharge a foam effluent for cleaning or other applications, while minimizing the accumulation of pressurized foam within a spray hose between uses. As set forth more fully below, the foam sprayer includes a control valve to selectively allow the supply of pressurized foam to a spray hose when a foam effluent is desired, and a spray nozzle that remains open both during and between periods of use.

Figure 1:
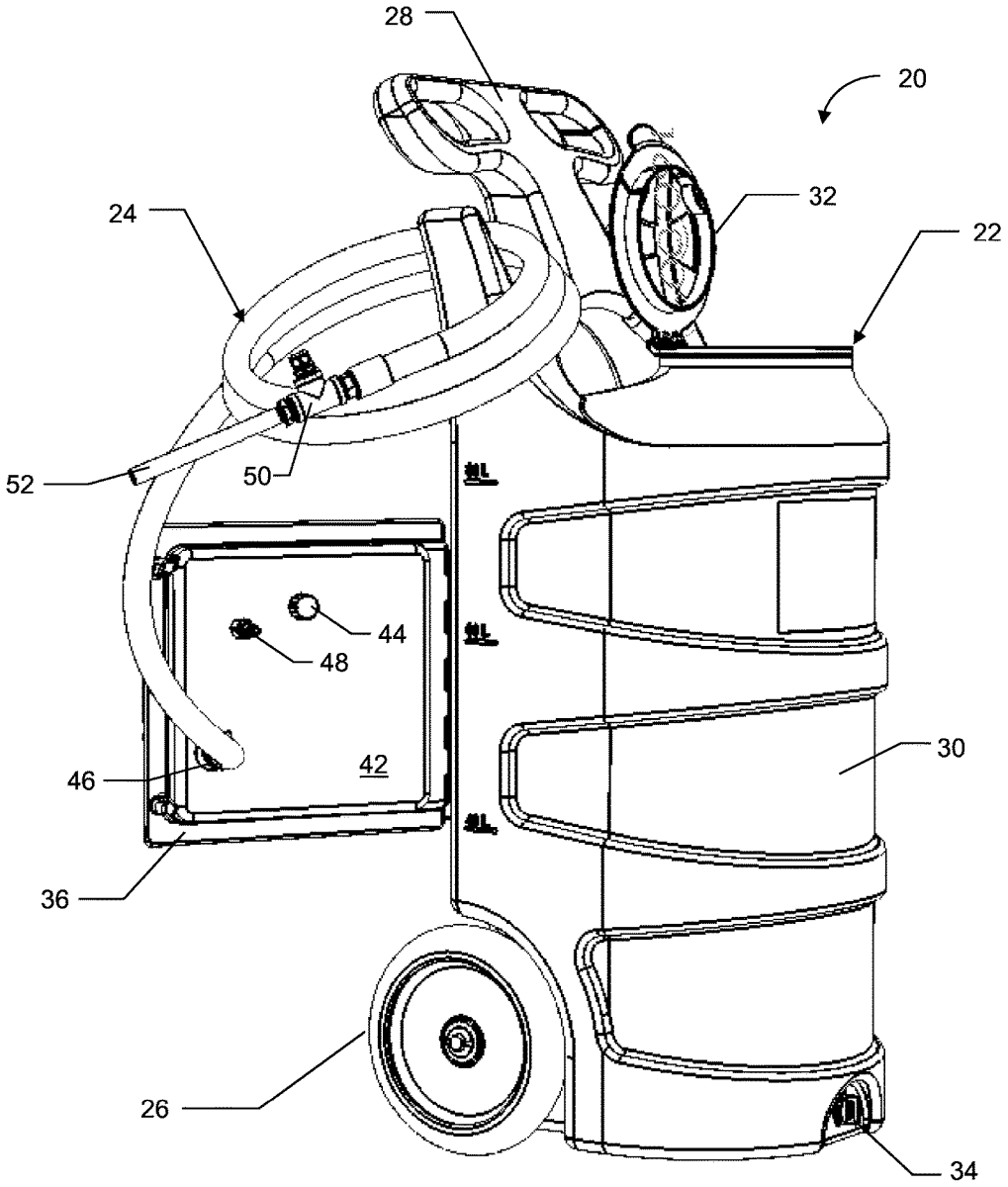
FIG. 1 is a first perspective view of a foam sprayer in accordance with an embodiment of the present invention.

Referring now to FIG. 1, a pneumatically powered foam sprayer in accordance with one embodiment is illustrated and generally designated 20. The foam sprayer 20 includes a base unit 22 and a spray hose 24. The base unit 22 is depicted as a mobile base unit in the present embodiment, while in other embodiments the base unit 22 remains stationary, optionally being a wall mounted base unit. As shown in FIG. 1, the mobile base unit 22 includes first and second rear wheels 26 and a handle 28 to movably support a tank 30 across level and ramped surfaces. The tank 30 includes an internal volume in excess of 80 liters in the present embodiment, optionally being constructed from high density polyethylene (HDPE). In other embodiments, the tank 30 is composed of materials more resilient to corrosive chemicals, including stainless steel for example. The tank 30 additionally includes a fill cover 32 and a drain port 34 to facilitate the transfer of liquid foam components to and from the tank 30 between periods of use.

Figure 2:
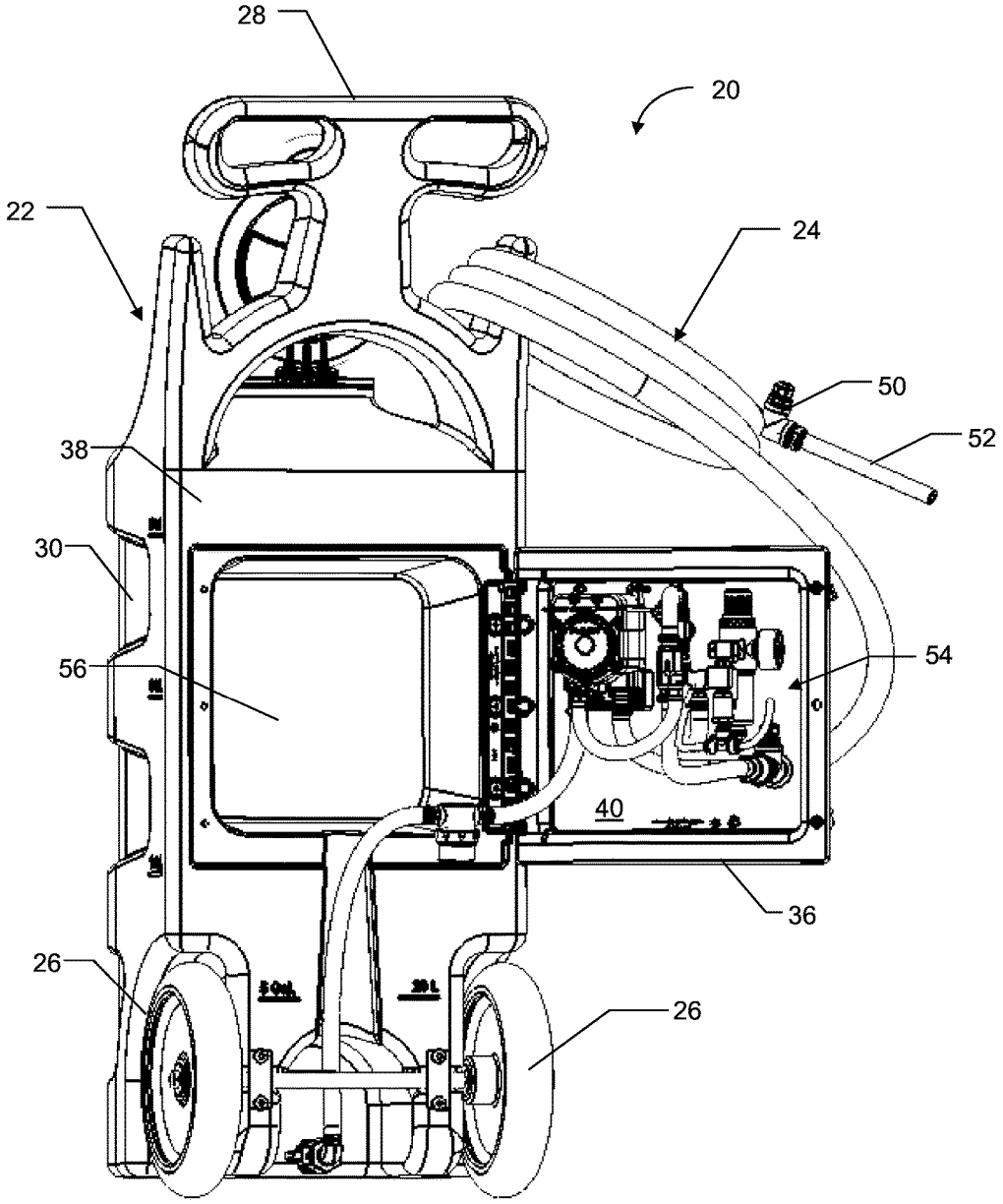
FIG. 2 is a second perspective view of the foam sprayer of FIG. 1 illustrating a control panel in the open position.

As also shown in FIG. 1, the foam sprayer 20 includes a hinged control panel 36. The hinged control panel 36 is moveable from a closed position, flush with the tank back surface 38, to an open position as generally depicted in FIG. 2. In addition, the hinged control panel 36 includes an inward facing surface 40 opposite an outward facing surface 42. As perhaps best shown in FIG. 1, the outward facing surface 42 includes a selector valve 44, a spray hose fitting 46, and a compressed air fitting 48. The selector valve 44 controls the amount of air intermixed with liquid foam components during aeration. For example, the clockwise rotation of the selector valve 44 increases the air-liquid ratio, while the counter-clockwise rotation of the control valve 44 decreases the air-liquid ratio. The spray hose 24 extends from the spray hose fitting 46, terminating at a trigger assembly 50 and a spray nozzle 52. The compressed air fitting 48 is attachable to a supply of compressed air, optionally an air compressor, including for example a 1.5 HP 110 VAC air compressor. The spray hose fitting 46 and the compressed air fitting 48 each include a hose barb fitting and a hose clamp, optionally being formed of stainless steel, while in other embodiments different fittings can be used as desired.

Figure 3:
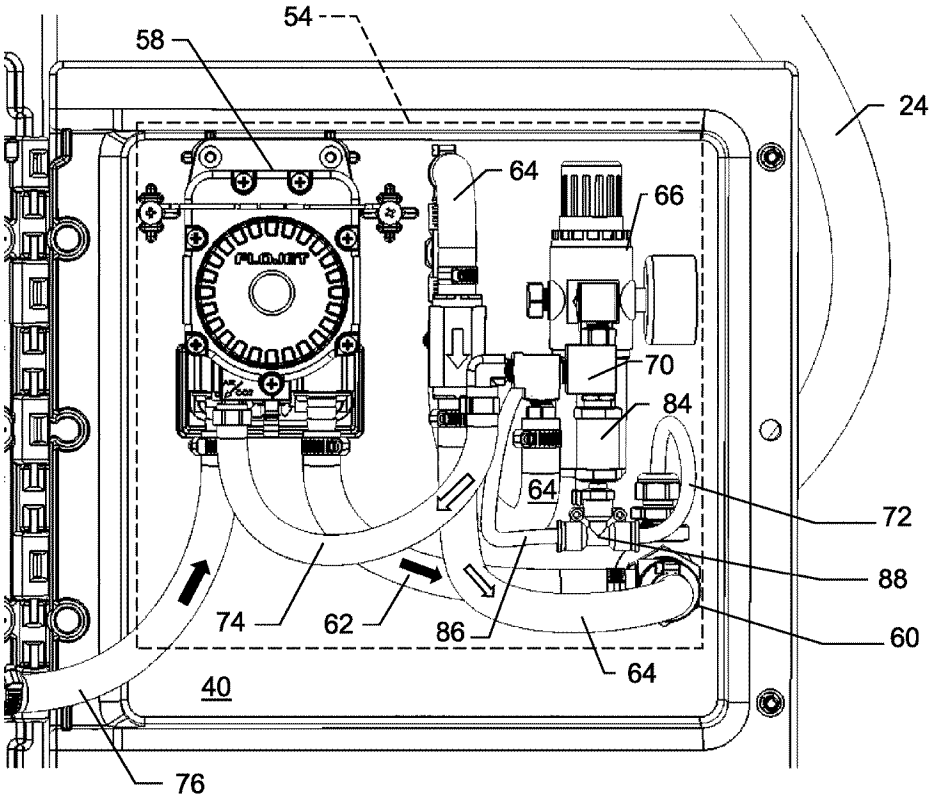
FIG. 3 is a close-up elevation view of the foam sprayer control panel illustrating the foam sprayer control system.
Figure 4:
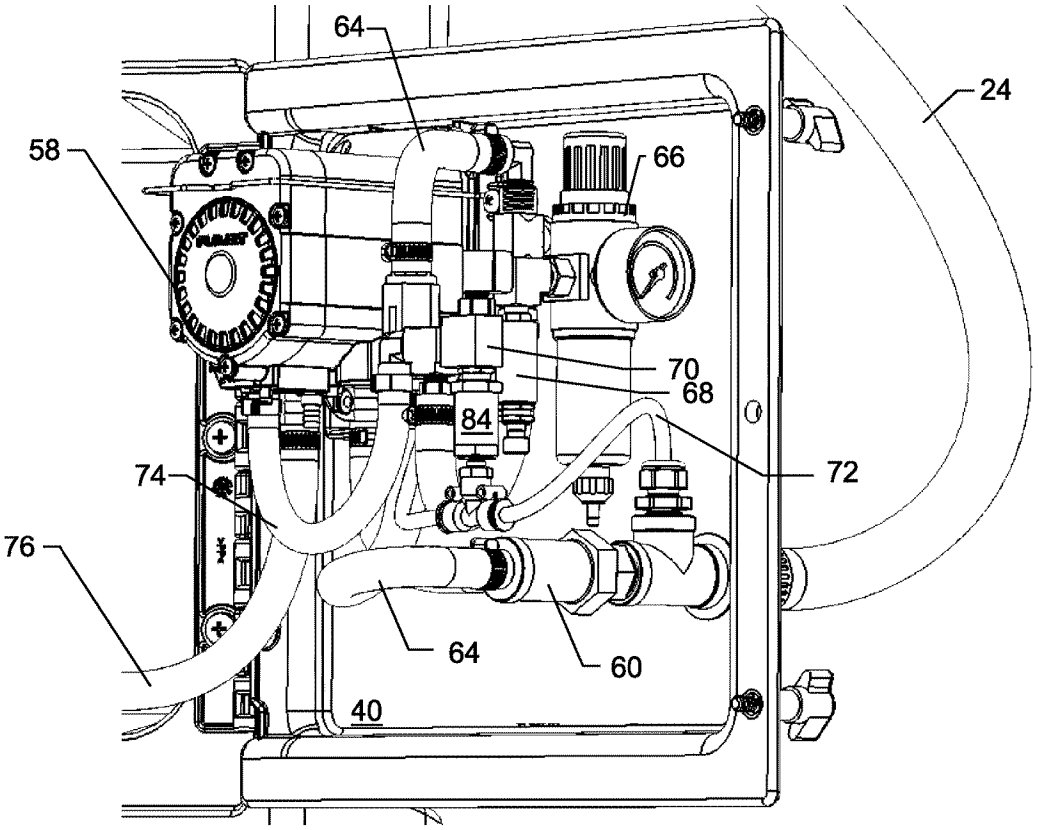
FIG. 4 is a perspective view of the control system of FIG. 3.
Figure 5:
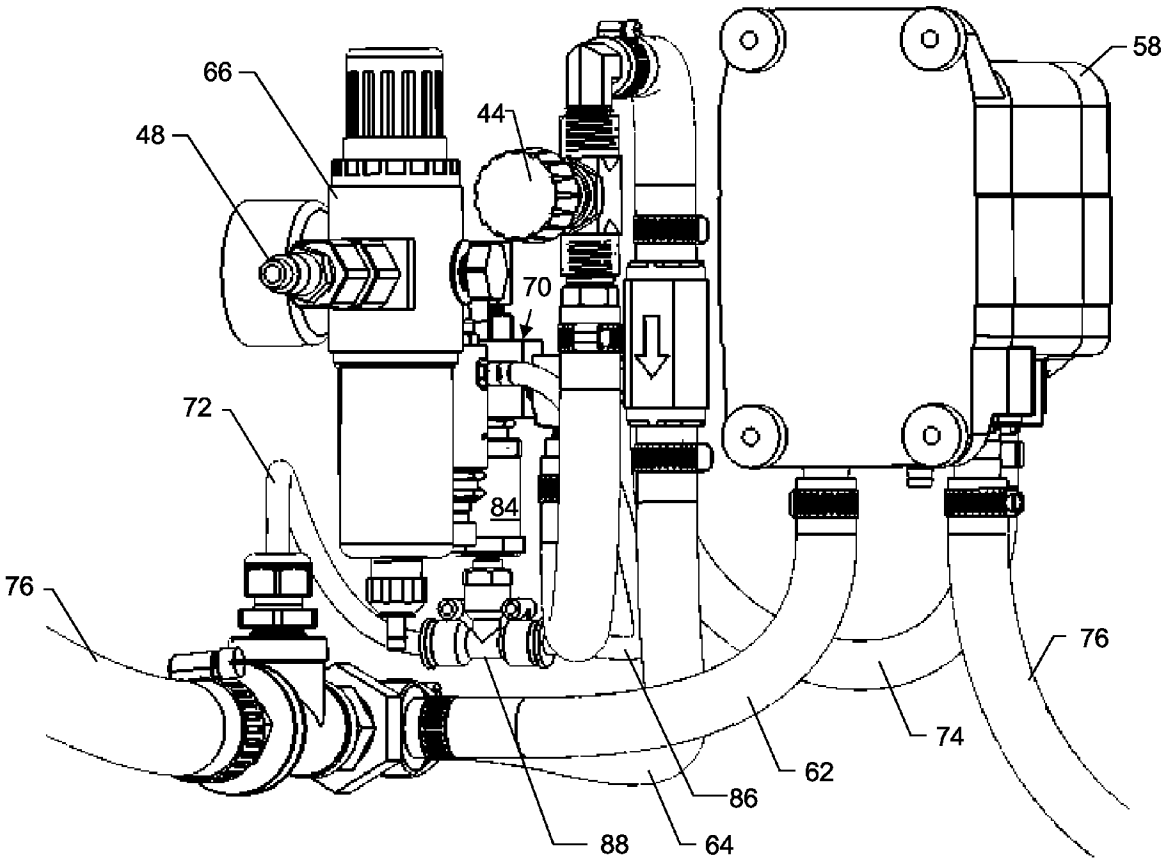
FIG. 5 is a rear view of the control system of FIG. 3 with the control panel removed for clarity.

Referring now to FIGS. 3-4, a base unit control system 54 is mounted to the control panel 36. In other embodiments, the control system 54 can be mounted within a recess 56 in the tank back surface 38. In these and other configurations, the control system 54 is generally operable to selectively allow the supply of pressurized foam to the spray hose 24 in response to an operator actuation of the trigger assembly 50. In particular, the control system 54 can optionally include a pneumatically powered pump 58, an aeration chamber 60, a liquid supply line 62 in fluid communication with the pump and the aeration chamber 60, an air supply line 64 in fluid communication with the selector valve 44 and the aeration chamber 60, first and second pressure regulators 66, 68, a pressure-actuated control valve 70 to control the flow of air and liquid to the aeration chamber 60, and an air conduit 72 in fluid communication with the trigger assembly 50 and the control valve 70.

As noted above, the pump 58 is generally configured to deliver liquid foam component(s) from the tank 30 to the aeration chamber 60. The liquid foam components are premixed in the present embodiment, including both foam concentrate and water. In other embodiments, however, the liquid foam components are not premixed. For example, the foam concentrate can be stored within the tank 30 and subsequently mixed with an external supply of water within a proportioning chamber upstream of the aeration chamber 60. In addition, the pump 58 can include any pump adapted to deliver the liquid foam components under pressure, including for example a pneumatically driven vacuum pump. A compressed air conduit 74 extends between the control valve 70 and the pump 58, such that the pump 58 is operable when a supply of compressed air is allowed through the control valve 70, that is, when the control valve 70 is open.

To reiterate, the pump 58 draws liquid foam components from the tank 30 through a first conduit 76 under negative pressure, and subsequently through a second conduit 62 (the liquid supply line) to the aeration chamber 60 under positive pressure. As perhaps best shown in FIG. 6, the aeration chamber 60 includes a first inlet 78 coupled to the liquid supply line 62, a second inlet 80 coupled to the air supply line 64, and an outlet 82 coupled to the spray hose 24. The air supply line 64 extends from the control valve 70, through the selector valve 44, and to the second inlet 80. Accordingly, liquid foam components (represented by the solid arrow in FIG. 3) are supplied through the first inlet 78 and compressed air (represented by the open arrow in FIG. 3) is supplied through the second inlet 80. Internal turbulence within the aeration chamber 60 creates a foamy, heterogeneous effluent for discharge to the spray hose 24.

As noted above, the control system 54 includes a pressure-actuated control valve 70 to selectively direct the flow of compressed air to the pump 58 and to the aeration chamber 60. The control valve 70 can include any valve responsive to back pressure within the air conduit 72. In the present embodiment the control valve 70 includes a normally-closed two position poppet valve with a spring return 84. The air conduit 72 initially bypasses the control valve 70 through a bypass channel 86 extending between the regulator 66 and a t-fitting 88. The t-fitting 88 includes a first port in fluid communication with the poppet valve 84 and a second port in fluid communication with an air discharge port 90 in the trigger assembly 50. In the absence of an obstruction over the air discharge port 90, the flow of compressed air through the regulator 66 will escape through the air discharge port 90, and the poppet valve 84 will remain closed under the force of the spring return. When the air discharge port 90 is obstructed, the flow of compressed air through the regulator 66 will create a pressure build-up within the air conduit 72, and consequently the internal poppet valve 84. When the pressure build-up exceeds the force of the poppet valve spring return, the poppet valve 84 will actuate, opening the control valve 70. When the control valve 70 is open, compressed air is allowed to flow from the regulators 66, 68 through a forked elbow fitting 73 having first and second hose barb fittings 75, 77. The first hose barb fitting 75 is coupled to the compressed air conduit 74 for driving the pump 58, and the second hose barb fitting 77 is coupled to the air supply line 64. Removal of the obstruction over the air discharge port 90 causes a sudden drop in pressure within the air conduit 72, resulting in a rapid closing of the control valve 70. Consequently, compressed air does not flow through the forked elbow fitting 73 to the compressed air conduit 74 or to the air supply line 64 when the control valve 70 is closed.

Referring now to FIGS. 6-9, the spray hose 24 is generally depicted. The spray hose 24 includes a flexible, elongated conduit including an inlet 81 in fluid communication with the aeration chamber 76 and an outlet 83 in fluid communication with the trigger assembly 50 and spray nozzle 52. The air conduit 72 extends along a substantial portion of the length of the spray hose 24. In the present embodiment, the air conduit 72 extends along the interior of the spray hose 24. In other embodiments, however, the air conduit 72 extends along the exterior of the spray hose 24, optionally extending parallel to the spray hose 24 or being helically wound about the spray hose 24. In still other embodiments, the air conduit 72 does not form any part of the spray hose 24, and instead is separately coupled to the trigger assembly 50. The spray hose 24 is generally formed of a chemical resistant material, including for example a Goodyear® Horizon® hose available from Veyance Technologies, Inc., of Fairlawn, Ohio.

Figure 6:
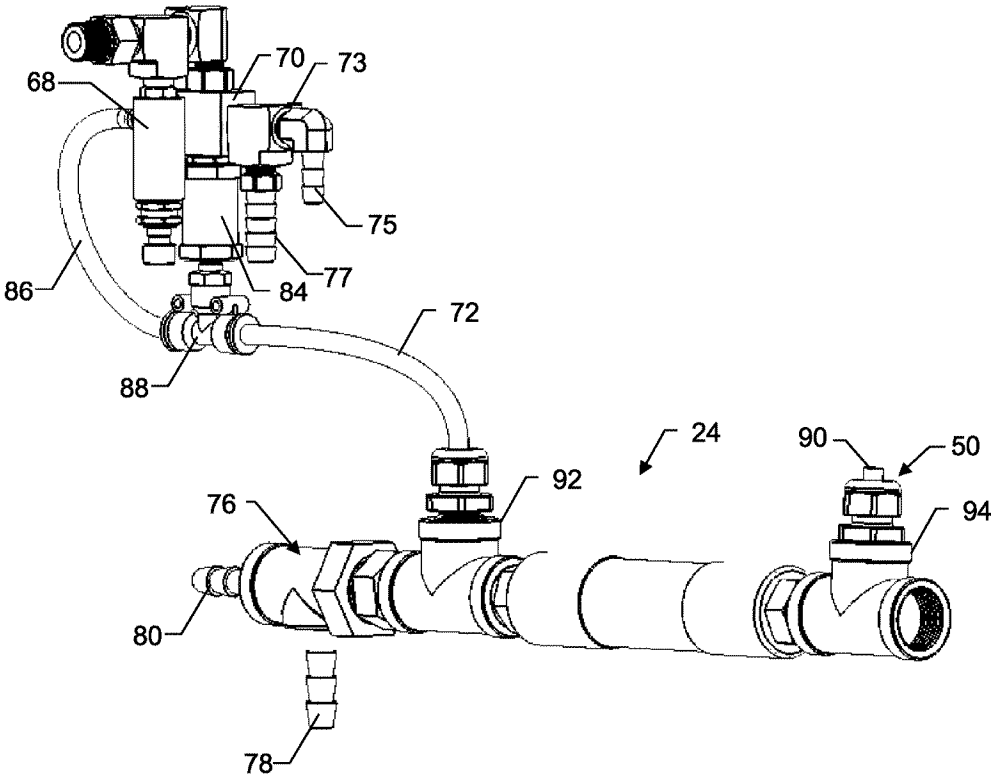
FIG. 6 is a perspective view of a spray hose and a trigger assembly.
Figure 7:
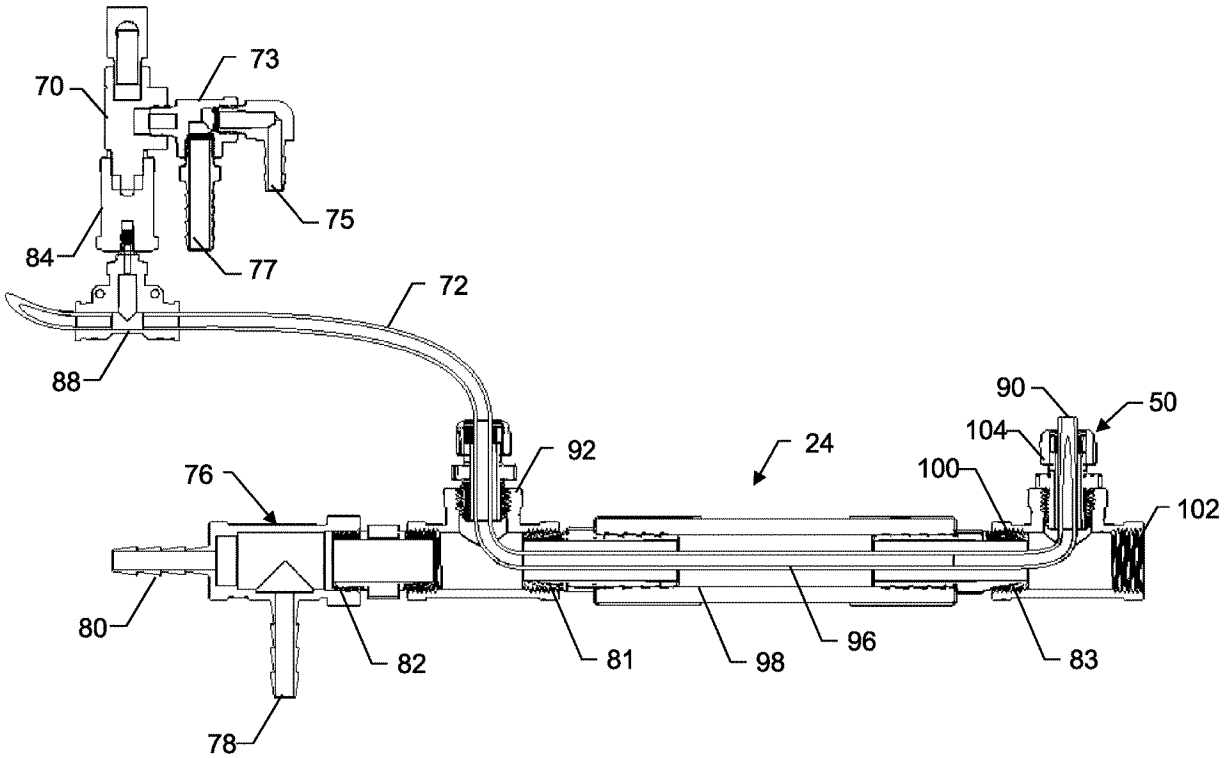
FIG. 7 is a cross-sectional view of the spray hose and trigger assembly of FIG. 6.

In embodiments where the air conduit 72 extends through the interior of the spray hose 24, and as generally shown in FIGS. 6-7, the air conduit 72 can enter the spray hose 24 through a first t-fitting 92, flexing substantially ninety degrees, and departing from the spray hose 24 through a second t-fitting 94, again flexing substantially ninety degrees. The air conduit 72 includes a flexible, corrosive resistant, laminar outer surface in the present embodiment, being at least as flexible as the spray hose 24 to permit coiling of the spray hose as shown in FIGS. 1-2. In addition, the air conduit outer surface 96 is spaced apart from the spray hose inner surface 98, optionally being concentrically located within the spray hose 24 to limit losses in foam consistency during travel of the foam effluent through the spray hose 24.

Figure 8:
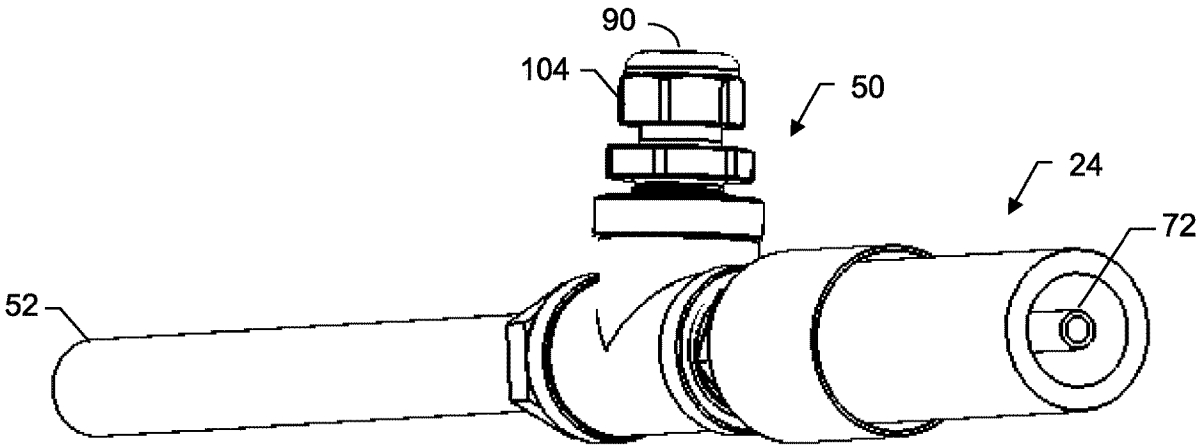
FIG. 8 is a perspective view of the trigger assembly including a spray nozzle.

Referring now to FIG. 8, the trigger assembly 50 and the spray nozzle 92 are depicted. In particular, the trigger assembly 50 includes an inlet 100 coupled to the spray hose 24, an outlet 102 coupled to the spray nozzle 52, and an upward extending boss 104 including the air discharge port 90. The inlet 100 and the outlet 102 include internal threads for attachment to the spray hose 24 and the spray nozzle 52, respectively. In addition, the boss 104 snugly receives the air conduit 72 therein, such that pressurized foam effluent does not escape upwardly through the air discharge port 90. For example, the boss 104 can include a series of o-rings disposed about the air conduit 72 to prevent the upward escape of pressurized foam effluent.

The spray nozzle 52 is also depicted in FIG. 8. As noted above, the spray nozzle 52 lacks an internal valve in the present embodiment, and remains open to prevent the accumulation of pressurized foam effluent within the spray hose 24. The spray nozzle 52 can include any nozzle adapted to provide a desired spray pattern. Desired spray patterns can vary with application, but can include a straight stream, a conical mist, or a fan pattern. Further optionally, the spray nozzle 52 can include a variable internal geometry, each providing a usable passageway for foam effluent, to produce different spray pattern characteristics. In addition, the spray nozzle 52 can include an internal mixing medium to further facilitate mixing of the liquid foam components and air. For example, the spray nozzle 52 can include a small section of Scotch-Brite 8440 (available from 3M, Minneapolis, Minn.) as generally set forth in U.S. Pat. No. 7,753,290 to Jacques et al, the disclosure of which is incorporated by reference in its entirety.

In operation, the powered foam sprayer operator attaches a supply of compressed air to the compressed air fitting 48 on the exterior of the control panel 36. As noted above, the supply of compressed air can include, for example, a 1.5 HP 110 VAC air compressor if a ready supply of compressed air is otherwise not available. When the compressor is turned on, compressed air is directed through the compressed air fitting 48, the first regulator 66, and the second regulator 68 to the bypass channel 86 of the air conduit 72. If the air discharge port 90 is free from obstruction, the compressed air is allowed to escape through the trigger assembly 50. The operator then uncoils the spray hose 24 and points the spray nozzle 52 in the general direction of the surface to be treated. When desired, the operator places a hand, a finger, or a thumb over the air discharge port 90. Back pressure in the air conduit 72 causes the control valve 70 to actuate, thereby allowing the flow of compressed air through the forked elbow fitting 73 to both of the pump 58 and the foam aeration chamber 60. Liquid foam components are supplied to the foam aeration chamber 60 under positive pressure from the pump 58. When in the foam aeration chamber, the liquid foam components and the compressed air intermix to form a foamy, heterogeneous mixture. The foamy mixture then travels through the spray hose 24, along an exterior portion of the air conduit, escaping through the spray nozzle 52 in a desired spray pattern. The operator can additionally adjust the selector valve 44 to achieve the desired foam consistency both during and between uses.

When a foam effluent is no longer desired, the operator simply removes his or her hand, finger or thumb from the air discharge port 90 in the trigger assembly 50. The resulting drop in pressure in the air conduit 72 causes the control valve 70 to rapidly close. Lacking a supply of compressed air, the pump 58 ceases to operate, and the aeration chamber ceases to receive liquid foam components. In addition, the aeration chamber 60 ceases to receive a supply of compressed air. Consequently, the foamy mixture already within the spray hose 24 is allowed to drain through the spray nozzle 52, optionally under pressure from the last slug of compressed air moving through the air supply line 64. As a final step, the operator disconnects the supply of compressed air from the compressed air fitting 48 and coils the spray hose 24 as generally depicted in FIGS. 1-2 for storage between uses.

Accordingly, the foam sprayer 20 provides a ready supply of foam effluent for cleaning and other applications, while generally avoiding the buildup of pressurized foam within the spray hose 24. Particularly where the foam effluent includes caustic chemicals, the foam sprayer 20 of the present invention can lessen the risk of harm associated with the discharge of foam effluent caused by the removal of the spray hose 24 from the base unit 22 or the inadvertent actuation of a manually operated trigger. In addition, the foam sprayer 20 can be implemented as a standalone mobile unit, and can also be implemented as a stationary unit, for example a wall mounted unit, or a vehicle mounted unit. In these and other embodiments, the foam sprayer can include an onboard supply of compressed air, in which instance the foam sprayer can also include an internal or external source of electrical power. Still further optionally, the foam sprayer can include an external supply of water to intermix with foam concentrate in a proportioning chamber to optionally reduce the size and storage capacity of the storage tank.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The invention claimed is:

1. A powered foam sprayer comprising:

a base unit having a tank containing a liquid foam component, a pump operatively coupled to the tank whereby operation of the pump moves the liquid foam component from the tank, and a control valve coupled to the pump, the control valve having a first position in which the pump is engaged and a second position in which the pump is disengaged;

a trigger assembly located remotely from the base unit;

a spray nozzle located remotely from the base unit proximate the trigger assembly;

a spray hose extending from the base unit to the spray nozzle, the spray hose including an inlet toward a first end to receive a pressurized supply of foam from the base unit and an outlet toward a second end to deliver the supply of foam to the spray nozzle for discharge of the pressurized supply of foam, the spray hose and the spray nozzle lacking a valve, whereby the spray hose and the spray nozzle remain open to prevent accumulation of pressurized foam within the spray hose between actuations;

an air conduit extending from the base unit to the trigger assembly proximate the spray nozzle, the trigger assembly operable between an open state and a closed state to control the level of air pressure within the air conduit; and the control valve in fluid communication with the air conduit, the control valve movable into the first position to deliver the liquid foam component and compressed air to a foam aeration chamber which provides the pressurized supply of foam to the spray hose inlet and the second position to terminate the delivery of the pressurized supply of foam to the spray hose inlet, the control valve being operable between the first position and the second position based on the level of air pressure within the air conduit;

wherein the air conduit is not in fluid communication with the spray hose.

2. The powered foam sprayer of claim 1 wherein the trigger assembly includes an opening in fluid communication with the air conduit and exposed to the atmosphere that, when obstructed, varies the level of air pressure within the air conduit.

3. The powered foam sprayer of claim 1 wherein the air conduit extends longitudinally through a substantial portion of the spray hose.

4. The powered foam sprayer of claim 1 further including a pneumatically powered pump driven by compressed air directed through the control valve.

5. The powered foam sprayer of claim 1 wherein the air conduit is not in fluid communication with the foam aeration chamber.

6. The powered foam sprayer of claim 5 wherein the liquid foam includes a foam-water mixture.

7. The powered foam sprayer of claim 6 further including a selector valve to control the supply of compressed air to the foam aeration chamber.

8. A powered foam sprayer comprising:

a base unit having a tank containing a liquid foam component, a pump operatively coupled to the tank whereby operation of the pump moves the liquid foam component from the tank, and an air-actuated control valve coupled to the pump;

a trigger assembly located remotely from the base unit;

a spray nozzle located remotely from the base unit proximate the trigger assembly;

an aeration chamber disposed within the base unit to receive the liquid foam component and compressed air and including an outlet to discharge pressurized foam;

a spray hose extending between the base unit and the spray nozzle to deliver the pressurized foam to a locate remote from the base unit, the spray hose in fluid communication with the aeration chamber to receive the pressurized foam, the spray hose and the spray nozzle lacking a valve, whereby the spray hose and the spray nozzle remain open to prevent accumulation of pressurized foam within the spray hose between actuations;

the air pressure-actuated control valve selectively operable between a first position to engage the pump and to allow the supply of the flow of the liquid foam component and compressed air to the aeration chamber and a second position to disengage the pump and cease the supply of the flow of first and second foam constituents to the aeration chamber;

the trigger assembly coupled to the spray nozzle and adapted to actuate the air pressure-actuated control valve; and an air conduit extending between the air pressure-actuated control valve in the base unit and the trigger assembly, the air pressure-actuated control valve operable between the first position and the second position based on the level of air pressure within the air conduit;

wherein the air conduit is not in fluid communication with the spray hose or the aeration chamber; and wherein the spray hose is substantially free of the pressurized foam between actuations.

9. The powered foam sprayer of claim 8 wherein the trigger assembly includes an opening in fluid communication with the air conduit and exposed to the atmosphere that, when covered, causes the air pressure-actuated control valve to actuate.

10. The powered foam sprayer of claim 9 wherein:

if the trigger assembly opening is covered, the spray nozzle discharges pressurized foam; and if the trigger assembly opening is uncovered, the spray nozzle does not discharge pressurized foam.

11. The powered foam sprayer of claim 8 wherein the air conduit extends through a substantial portion of the spray hose.

12. The powered foam sprayer of claim 8 wherein the air conduit extends along an exterior of the spray hose.

13. The powered foam sprayer of claim 8 wherein the spray hose and the air conduit are formed from chemical-resistant materials.

14. A foam sprayer comprising:

a base unit having a tank containing a liquid foam component, a pump operatively coupled to the tank whereby operation of the pump moves the liquid foam component from the tank, and a control valve coupled to the pump and operable between a first position in which the pump is engaged and a second position in which the pump is disengaged;

a spray nozzle located remotely from the base unit;

a spray hose extending between the base unit and the spray nozzle, the spray hose having an inlet and an outlet, the outlet connected to the spray nozzle, the spray hose and the spray nozzle lacking a valve, whereby the spray hose and the spray nozzle remain open to prevent accumulation of pressurized foam within the spray hose between actuations;

an air conduit extending between the control valve and a location proximate the spray nozzle, the air conduit extending longitudinally along the spray hose and including an opening exposed to the atmosphere, the opening being proximate the spray nozzle and being separate from the spray hose outlet; and the air conduit in fluid communication with the air pressure-actuated control valve and operable to selectively move the control valve into the first position to engage the pump and to allow a supply of liquid foam and compressed air to a foam aeration chamber which provides the pressurized foam to the spray hose inlet in response to greater air pressure within the air conduit resulting from an obstruction of the air conduit opening and to selectively move the control valve into the second position to disengage the pump in response to lower air pressure within the air conduit resulting from there being no obstruction of the air conduit opening;

wherein the air conduit is not in fluid communication with the spray hose.

15. The foam sprayer of claim 14 further wherein the foam aeration chamber is in fluid communication with the spray hose inlet and further including a pneumatically-driven pump configured to pump a foam-water mixture under pressure to the foam aeration chamber, wherein the air conduit is not in fluid communication with the foam aeration chamber.

16. The foam sprayer of claim 15 wherein the air pressure-actuated control valve terminates the flow of compressed air to the pneumatically-driven pump and to the foam aeration chamber when air pressure within the air conduit falls above or below a predetermined level.

17. The foam sprayer of claim 14 wherein the air conduit extends within an interior portion of the spray hose.

18. The foam sprayer of claim 14 wherein the air conduit extends along an exterior of the spray hose.

19. The foam sprayer of claim 14 wherein the air conduit is in fluid communication with an external source of compressed air.

20. The foam sprayer of claim 14 further including a pneumatically powered pump driven by compressed air directed through the air pressure-actuated control valve.

* * * * *